US005682931A

United States Patent [19]

Mouchmouchian

[11] Patent Number: 5,682,931

[45] Date of Patent: Nov. 4, 1997

[54] BABY FEEDING BOTTLE

[75] Inventor: Silva Mouchmouchian, Los Angeles, Calif.

[73] Assignee: Munchkin, Inc., Van Nuys, Calif.

[21] Appl. No.: 508,718

[22] Filed: Jul. 28, 1995

[51] Int. Cl.[6] ..... B65B 1/04

[52] U.S. Cl. ..... 141/319; 141/364; 141/18; 141/346; 141/366; 222/205; 222/528; 285/177

[58] Field of Search ..... 141/114, 364, 141/319, 346, 366, 386, 391, 106, 108, 109, 367, 18, 363, 365, 369, 372, 382, 384; 222/192, 205, 528; 285/177; 215/11.1, 11.3, 11.6; 220/669, 674, 675

[56] References Cited

U.S. PATENT DOCUMENTS

| | | | |
|---|---|---|---|
| 3,530,979 | 9/1970 | Merrill, Jr. et al. | 215/11.6 |
| 4,091,965 | 5/1978 | Gebhard | 222/192 |
| 5,303,834 | 4/1994 | Krishnakumar et al. | 220/675 |
| 5,305,928 | 4/1994 | Verdaguer | 222/192 |
| 5,462,101 | 10/1995 | Mouchmouchian | 141/364 |

*Primary Examiner*—Henry J. Recla
*Assistant Examiner*—Steven O. Douglas
*Attorney, Agent, or Firm*—Allan M. Shapiro

[57] ABSTRACT

A baby food jar is directly attachable to the top of a squeezable baby bottle so that the baby food jar can be inverted on the sgueezable bottle to gravitationally transfer the baby food without spilling. Thereafter, a feeding member includes a nozzle which attaches directly to the squeezable baby bottle. The nozzle terminates in a baby feeding spoon. Squeezing the bottle delivers baby food directly to the spoon.

20 Claims, 2 Drawing Sheets

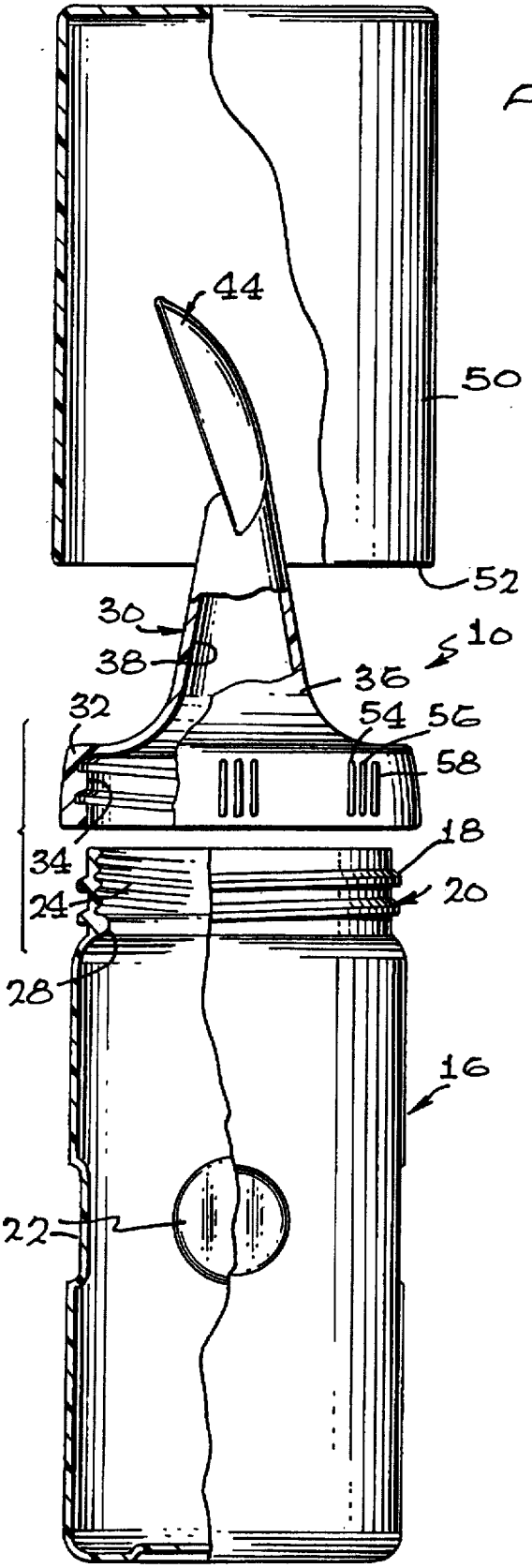
FIG. 1
FIG. 2
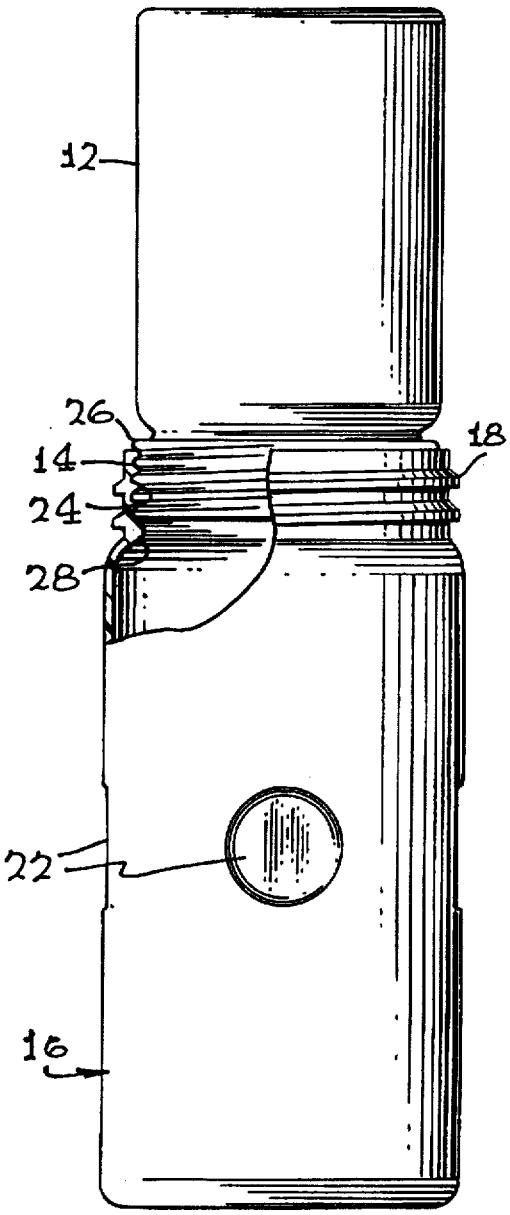

BABY FEEDING BOTTLE

FIELD OF THE INVENTION

This invention is directed to a baby feeding bottle which includes a squeezable bottle which is configured to receive an inverted baby food jar on its top so that the bottle gravitationally receives baby food from the jar. The feeding member includes a spoon-carrying nozzle which attaches to the squeezable baby bottle, now containing baby food, to directly deliver baby food to the spoon for baby feeding.

BACKGROUND OF THE INVENTION

Initially, babies are fed with milk or a nutritionally balanced milk substitute. Except for nursing the baby, the milk is usually delivered by a baby bottle. The baby bottle comprises a vessel and a rubber nipple configured in size and shape for the baby's mouth. A number of different kinds of vessels are available, including rigid glass vessels, substantially rigid synthetic polymer composition material vessels, squeezable polymer vessels, and thin-walled polymer bags which are often employed in a holder.

As the baby grows, his feeding is supplemented with "solid" foods. These foods are not really solid, but are semi-fluid in nature. These foods include smooth oatmeal, smooth fruit, smooth vegetables and smooth meat, usually chicken. These food materials are pureed and adjusted in viscosity. In manufacture, they are placed in jars and sterilized. The jars are closed with screw caps which are removed for feeding of the baby. When the baby is first switched from milk to solid food, the transition is more easily achieved when the solid food is warmed to body temperature. A serving of the solid food is spooned from the baby jar into the dish in which it is warmed. Then, the mother uses a small spoon to feed the baby from the dish. Later, when the baby is older, it may not be helpful or necessary to warm the food. In that case, the mother may feed the baby directly from the baby food jar. In that instance, the mother uses a small spoon, scoops a small amount of this pureed food from the jar, and uses the spoon to place it in the baby's mouth. This feeding often takes place with the baby in a seated, upright position and held in position, as in a high chair. This is usually a two-handed operation because the dish or baby food jar must be held in one hand while the pureed baby food is spooned out. This is particularly true when there is not an adjacent table on which to place the dish or baby food jar.

While this invention is described in association with pureed baby food, it is clear that it can also be used with junior baby food which includes chopped food with the puree. Thus, use of the bottle is practical when any baby food has the proper fluidity and its individual components are not too large to pass through the openings of the bottle. Of course, this process is utilized numerous times for each baby and, thus, is a process which is repeated many times each day throughout the United States. There is need for a baby-feeding bottle which more easily permits achieving the baby-feeding process.

SUMMARY OF THE INVENTION

In order to aid in the understanding of this invention, it can be stated in essentially summary form that it is directed to a baby feeding bottle which includes a squeezable bottle sized to transfer efficiently and gravitationally pureed baby food from jar to bottle without mess and which includes a feeding structure which subsequently attaches to the squeezable baby bottle. The feeding structure includes a spout or nozzle which has a spoon formed therewith so that the baby may be fed baby food on the spoon by squeezing the bottle.

It is thus an object and advantage of this invention to provide a baby feeding bottle which includes a baby food jar which directly attaches to a squeezable bottle to transfer gravitationally baby food from a baby food Jar into a squeezable baby bottle without mess and without the opportunity for exterior contamination.

It is another object and advantage of this invention to provide a baby feeding bottle which includes a squeezable baby bottle together with a feeding structure which attaches thereto so that baby food can be extruded from the bottle onto the integral spoon on the feeding structure.

It is another object and advantage of this invention to provide a baby feeding bottle which is economic of construction and which is easy to use so that it may be widely utilized.

It is another object and advantage of this invention to provide a baby feeding bottle which permits the user to feed solid food to the baby with only one hand, without having to manipulate a baby food jar.

It is a further object and advantage of this invention to provide a baby feeding system which avoids contamination of the baby food during transfer from jar to bottle by employment of a direct transfer.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is a side-elevational view of the first preferred embodiment of the bottle showing the components of the bottle in relationship to each other.

FIG. 2 is a side-elevational view, with parts broken away and parts taken in section, showing a baby food jar screwed into the squeezable baby bottle of FIG. 1.

DESCRIPTION OF THE PREFERRED EMBODIMENTS

Figure 3:
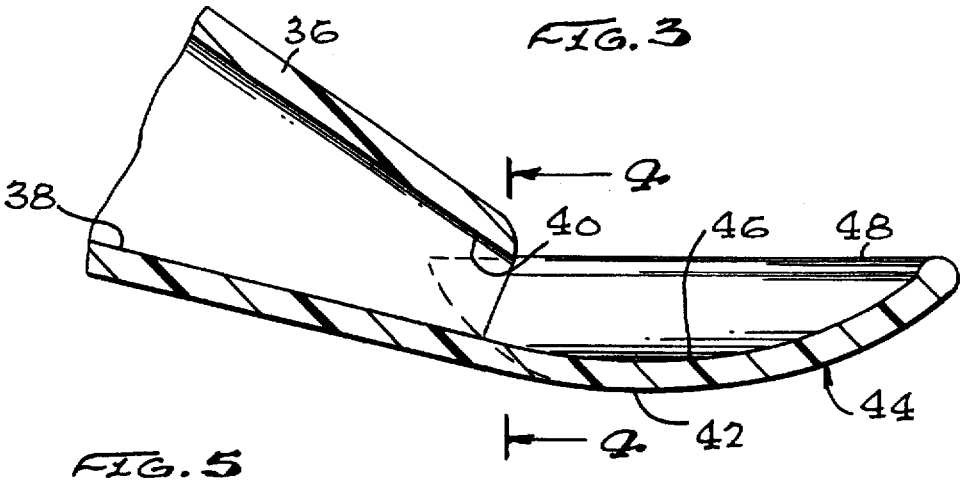
FIG. 3 is an enlarged central section through the nozzle and spoon of the feeding structure, which is mostly seen in side-elevational view in FIG. 1.

The first preferred embodiment of the baby feeding bottle is generally indicated at 10 in FIG. 1. Food is delivered from a standard baby food jar 12 seen in FIG. 2. The baby food in the jar is either pureed or finely chopped. The jar 12 comes supplied with a screw thread 14 around its neck to which the conventional jar top is attached by the manufacturer. As long as this jar top stays in place, the contents of the baby food jar remain sterile. The jar is conventionally rigid; for example, being made of glass. Baby food is delivered from the baby food jar 12 to baby bottle 16. The baby bottle 16 is provided with screw threads 18 around its neck 20. The baby bottle 16 is made of synthetic polymer composition material and is of such thickness and of such resiliency that the bottle 16 is squeezable to expel the contents. Such baby bottles are conventionally provided with volume marks to indicate to the person doing the feeding the amount of remaining milk or baby food therein. Baby food bottle 16 has four dimples 22 around its periphery about halfway up the height of the bottle. These dimples interrupt the otherwise circular cylindrical tubular shape of the body of the bottle 16 in order to aid in its squeezability. The neck 20 of the bottle 16 has interior threads 24 which are sized to receive the threads 14 on the neck of the baby food jar 12. It is the assembly of the baby food jar 12 on the top of the squeezable baby bottle 16 which permits gravitational transfer of the contents of the baby food jar into the squeezable baby bottle. A shoulder 26 may be formed on the baby food jar to prevent the jar from being threaded too far into the bottle. However, the constructions of such jars may not have that limiting shoulder. In order to prevent the jar from being threaded all the way into the bottle, for jars of a small diameter and absence of such a shoulder, shoulder 28 is formed within neck 20 below threads 24 to prevent the jar 12 from screwing in too far. With the baby jar attached to the baby bottle with the baby jar inverted, as shown in FIG. 2, the baby food gravitates into the bottle. This can be done ahead of time to maximize transfer of the baby food from the jar into the bottle. The combination may stand in the refrigerator in this transfer position until it is desired to feed the baby.

Figure 4:
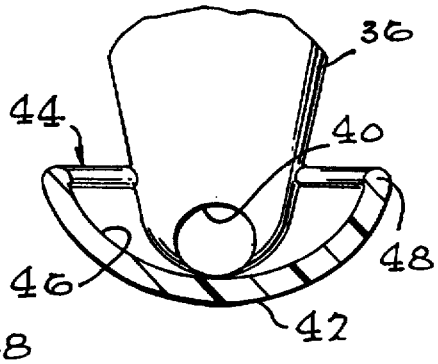
FIG. 4 is a section taken generally along line 4—4 of FIG. 3, with parts broken away.

When it is desired that the baby be fed, the baby food jar 12 is removed and the feeding structure 30 is attached. The feeding structure 30 has a hub 32 which has interior threads 34 therein, which match the threads 18 on the exterior of the neck of the squeezable baby bottle 16. Integrally formed with the hub 32 is tapered nozzle 36, which has interior passage 38 therein. The interior passage 38 is open from the interior of the hub where it is in communication with the interior of the squeezable baby bottle 16 to the nozzle opening 40, which is best seen in FIGS. 3 and 4. The nozzle 36 is generally in the shape of a truncated right circular cone, which has its axis coincident with the axis of the hub 32. The base of the cone transitions outwardly in a smooth curve to become substantially radial where it joins the hub with its interior threads.

The forward end of the tapered nozzle beyond the nozzle opening 40 transitions to become tangent with the lower outside surface 42 of spoon bowl 44. The inside surface 46 of the spoon bowl is tangent to the inside surface 38 of nozzle 36, as is seen in FIGS. 3 and 4. The opening 40 thus enters directly into the spoon bowl. The top of the nozzle opening 40 is in line with the top edge of the spoon bowl, as seen in FIG. 3. It can be understood that, under some circumstances, the baby food gushes out of the nozzle opening 40. For this reason, the upper edge of the spoon bowl is provided with a beaded or rolled edge 48. This is a smoother edge for feeding the baby, but it should be noted that the entire bead is on the inside of the bowl to help prevent spillage.

Cup 50, see FIG. 1, has at its open edge 52 a tube of circular cross section. It is illustrated to be a simple cup with cylindrical sides and closed bottom and is shown in the inverted position. The cup is sized to slip down over the hub 32. The cup serves as protection for the feeding structure 30 during shipment and can be used as a closure for the nozzle and cover for the spoon when there is food in the squeezable baby bottle. In order to provide proper fit of the cup onto the hub, the hub is provided with six groups of three ribs around its periphery. Ribs 54, 56 and 58 form one identified set in FIG. 1. Another set of ribs is also illustrated, and it is understood that there are six sets around the periphery. The engagement of the cup over these ribs is sufficiently firm so that grasp of the cup is sufficient to unscrew the feeding structure from the squeezable baby bottle. When the squeezable baby bottle contains food, the feeding structure 30 is in place thereon and the cup is fitted over the feeding structure, the food is protected and the entire assembly of the baby bottle can be placed in the refrigerator for dinnertime future use. This food can be warmed in a microwave oven and the cup removed for feeding.

Feeding is accomplished by tilting the axis of the baby bottle downward, with the edge of the spoon bowl substantially level, as is seen in FIG. 3. In this position, the bottle is squeezed gently to deliver some of the baby food into the spoon bowl. The spoon bowl is then manipulated in the conventional manner. However, there is no need to have a separate bowl of baby food into which a spoon is dipped. Instead, the baby bottle is squeezed and more food is delivered to the spoon bowl. It is understood that such food cannot be saved for very long, but should the baby refuse to be fed, the cup 50 can be replaced and the assembly placed in the refrigerator for dinnertime future use.

Figure 5:
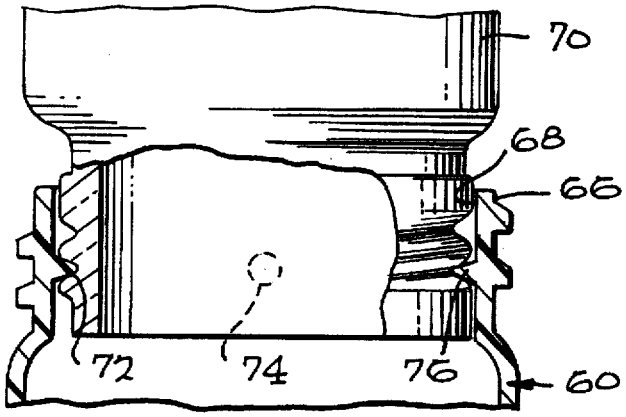
FIG. 5 is a side-elevational view, with parts broken away and parts taken in section, of a second preferred embodiment of the attachment structure which detachably retains a baby food jar on the top of the squeezable baby bottle.
Figure 6:
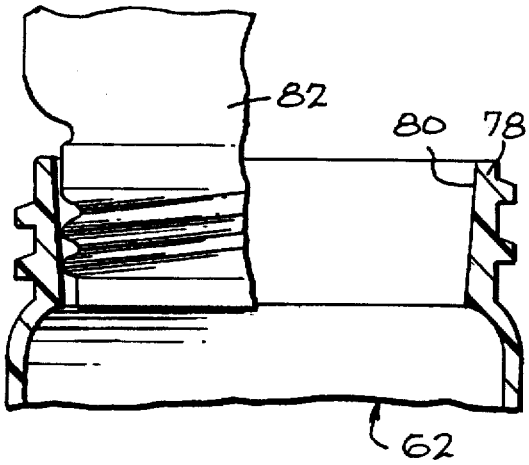
FIG. 6 is a view similar to FIG. 5 showing a third preferred embodiment thereof.
Figure 7:
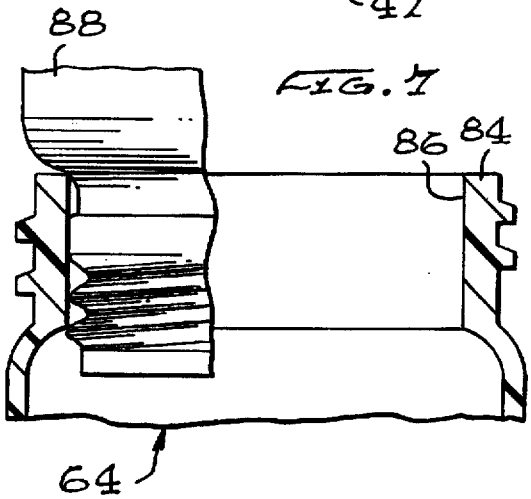
FIG. 7 is a view similar to FIG. 5 showing a fourth preferred embodiment thereof.

FIGS. 5, 6 and 7 show three slightly different squeezable baby bottles 60, 62 and 64. These are three different shapes of squeezable baby bottles with different configurations to receive and detachably attach a baby food jar for the delivery of food into the baby food bottle. The baby food bottles 60, 62 and 64 are each substantially the same as baby food bottle 16, including the dimples and external threads on the neck. Thus, any one of these baby food bottles can be used with the feeding structure 30.

Squeezable baby food bottle 60, shown in FIG. 5, has a neck 66 which has an interior opening 68, which is slightly larger than the threaded neck at the nominal top of baby food jar 70. The interior of the neck 66 has four projections molded therein. These projections extend into the opening 68. Projections 72, 74 and 76 are shown in FIG. 5. It is understood that another such projection is on the near side of the section line through the squeezable baby bottle 60. These projections engage into the threads on the neck of the baby food jar. The baby food jar may be inserted by screwing it onto the projections or may be inserted by simply pressing down on the baby food jar to deflect the projections. Removal is in the same manner.

The baby food bottle shown in FIG. 6 has a neck 78, which neck has the same exterior threads as the squeezable baby food bottle 16. Interiorly, the neck 78 has an opening defined by a tapered surface 80. The tapered surface 80 is sized to permit the neck of a baby food jar to be inserted therein and engage partway down, as illustrated by the baby food jar 82 shown in FIG. 6. Insertion of the baby food jar causes physical engagement which holds the baby food jar detachably in place. The baby food jar 82 can be removed by rocking it to disengage the baby food jar from the tapered interior surface.

Squeezable baby food bottle 64 has a neck 84 similar to neck 20 and fitted with the same exterior threads. The interior opening to the neck is defined by surface 86, which is a right circular cylindrical surface sized to receive the neck of baby food jar 88 in a slip fit. In this structure, the neck of the baby food jar is inserted into the neck of the squeezable baby bottle. The fit does not have to be a friction-fit because the shoulder of the baby food jar engages against the neck of the bottle, as seen in FIG. 7. In normal circumstances, the symmetry around the axis permits the baby food jar to stand on top, but some frictional fit is preferable to maximize stability.

In each case, the baby food jar rests on top of the squeezable baby bottle to deliver food gravitationally from the jar to the squeezable baby bottle. This delivery can be accomplished over time in the refrigerator in preparation. After delivery is complete, the jar is removed and the feeding structure 30 is installed on the squeezable baby bottle. If the food is not to be used immediately, the cup 50 is installed over the feeding structure to protect the spoon and food from contamination. When the baby is to be fed, the food is warmed up, cup 50 is removed, and feeding is commenced. At the completion of feeding, if the remaining food is to be saved, the cup 50 can be replaced and the baby feeding bottle placed in the refrigerator. In this way, the use of a separate bowl is avoided so that the person feeding the baby need not use an additional hand for holding that bowl.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A baby feeding bottle comprising:

a baby feeding bottle, said baby feeding bottle being made of resilient material so that it is squeezable to help in expelling the contents, said baby feeding bottle having a top and having an opening at said top, said baby feeding bottle being configured so that it can rest on a horizontal flat surface with said opening directed upwardly;

means integral with said baby feeding bottle at said opening being non-removable therefrom for detachably attaching a baby food jar thereto with the baby food jar in an inverted position when said baby feeding bottle is in an upright position; and a feeding structure, means for detachably attaching said feeding structure to said squeezable baby bottle at said opening thereof, said feeding structure having a spoon thereon sized for feeding a baby and an opening through said feeding structure from said attachment means to said spoon so that baby food can be delivered from said squeezable baby bottle to said spoon for one-handed feeding of a baby.

2. The baby feeding bottle of claim 1 further including a cup, said cup being sized to fit over said spoon and engage on said feeding structure to enclose said spoon, said cup being removable for baby feeding with said baby feeding bottle.

3. The baby feeding bottle of claim 1 wherein said means for detachable attachment of said feeding structure to said squeezable baby bottle is screw-thread attachment means.

4. The baby feeding bottle of claim 3 wherein said feeding structure has a hub thereon and said hub has internal threads therein, said squeezable baby bottle having external threads adjacent its opening so that said feeding structure can be threadedly engaged on said squeezable baby bottle.

5. The baby feeding bottle of claim 4 further including a cup, said cup being sized to fit over said spoon and engage on said feeding structure to enclose said spoon, said cup being removable for baby feeding with said baby feeding bottle.

6. The baby feeding bottle of claim 4 further including ribs on said hub, said ribs being configured to enhance engagement with said hub.

7. The baby feeding bottle of claim 6 further including a cup, said cup being sized to fit over said spoon and engage on said feeding structure to enclose said spoon, said cup being removable for baby feeding with said baby feeding bottle, said cup engaging on said ribs.

8. The baby feeding bottle of claim 6 wherein said squeezable baby bottle has means in the side walls thereof to enhance squeezability of said squeezable baby bottle.

9. The baby feeding bottle of claim 1 wherein said squeezable baby bottle has means in the side walls thereof to enhance squeezability of said squeezable baby bottle.

10. A baby feeding bottle comprising:

a bottle, said bottle having a base and side walls to define an open top bottle having a neck which defines a bottle opening, said base being positioned so that, when said bottle stands on its base, said opening is directed upwardly, said bottle being made of a flexible synthetic polymer composition material so that it may be squeezed to reduce the interior volume of said bottle, means on the interior of said neck for receiving the neck of a baby food jar so that a baby food jar may be mounted on the top of said squeezable bottle to deliver its contents gravitationally to said squeezable bottle, attachment means on the exterior of said neck of said squeezable bottle; and a feeding structure detachably attachable to said attachment means on the exterior of said neck, said feeding structure comprising a hub for detachable attachment to said attachment means, a nozzle attached to said hub and a spoon bowl attached to said nozzle, said nozzle having an opening therethrough in communication with said squeezable bottle and with said spoon bowl so that baby food can be delivered from said squeezable baby bottle into said spoon by squeezing on said squeezable baby bottle.

11. The baby feeding bottle of claim 10 wherein said hub, said nozzle and said spoon are formed as a unitary structure.

12. The baby feeding bottle of claim 11 wherein said spoon bowl has a bead around its edge to inhibit food from said nozzle from being expelled over said edge.

13. The baby feeding bottle of claim 12 further including a cup, said cup having side walls and a bottom, said side walls defining an opening to said cup opposite said bottom, said side walls at said opening being sized to releasably engage said hub so that said cup can be engaged over said nozzle on said spoon to protect said spoon and the food in said squeezable baby bottle from exterior contamination.

14. The baby feeding bottle of claim 13 wherein said hub has ribs thereon and said cup releasably engages on said ribs so that said cup can be grasped to aid in removal of said feeding structure from said squeezable baby bottle.

15. The baby feeding bottle of claim 10 wherein said squeezable baby bottle has a screw-threaded opening therein to receive the screw threads of a baby food jar.

16. The baby feeding bottle of claim 10 wherein said squeezable baby bottle has a tapered opening therein to receive therein the neck of a baby food jar.

17. The baby feeding bottle of claim 10 wherein said baby feeding bottle has an opening therein of substantially circular section sized to slidably receive the neck of a baby food jar therein.

18. A baby feeding bottle comprising:

a baby feeding bottle having side walls and a bottom and walls defining an opening opposite said bottom so that, when said bottle is resting on its bottom, said opening is substantially upwardly directed, said opening being configured to receive the neck of a baby food jar so that a baby food jar may be inverted into said opening to transfer baby food gravitationally from the jar into said bottle;

attachment means adjacent said opening for attaching a feeding structure thereto; and a feeding structure detachably attachable to said attachment means, said feeding structure including a tube and including a spoon bowl attached to said tube, said tube being open to said spoon bowl and through said attachment means to the interior of said baby feeding bottle so that baby food may be delivered from said baby feeding bottle onto said spoon bowl for feeding a baby.

19. The baby feeding bottle of claim 18 further including a cup having walls and an end, said walls defining an opening opposite said end, said opening being sized to engage on said feeding structure to enclose said spoon bowl and enclose said opening to said spoon bowl.

20. The baby feeding bottle of claim 19 wherein said attachment means on said feeding structure includes a hub and said cup detachably engages on said hub.

* * * * *